US009835334B2

(12) United States Patent
Ryon et al.

(10) Patent No.: US 9,835,334 B2
(45) Date of Patent: Dec. 5, 2017

(54) AIR ENTRANCE EFFECT

(71) Applicant: Delavan Inc, West Des Moines, IA (US)

(72) Inventors: Jason A. Ryon, Carlisle, IA (US); Philip E. Buelow, West Des Moines, IA (US)

(73) Assignee: Delavan Inc., West Des Moines, IA (US)

( * ) Notice: Subject to any disclaimer, the term of this patent is extended or adjusted under 35 U.S.C. 154(b) by 0 days.

(21) Appl. No.: 14/858,663

(22) Filed: Sep. 18, 2015

(65) Prior Publication Data

US 2017/0082288 A1 Mar. 23, 2017

(51) Int. Cl.

| | |
|---|---|
| ***F23R 3/14*** | (2006.01) |
| ***F23R 3/28*** | (2006.01) |
| ***F23D 11/10*** | (2006.01) |
| ***F23D 11/38*** | (2006.01) |

(52) U.S. Cl.

CPC ..... *F23R 3/14* (2013.01); *F23D 11/107* (2013.01); *F23D 11/383* (2013.01); *F23R 3/28* (2013.01); *F23R 3/286* (2013.01); *F23D 2206/10* (2013.01)

(58) Field of Classification Search

CPC ..... F23R 3/14; F23R 3/286

USPC ..... 239/403

See application file for complete search history.

(56) References Cited

U.S. PATENT DOCUMENTS

| | | | | |
|---|---|---|---|---|
| 6,073,436 | A | 6/2000 | Bell et al. | |
| 8,196,845 | B2 | 6/2012 | Thomson et al. | |
| 2010/0119366 | A1* | 5/2010 | Bushnell | F04D 29/544 415/208.2 |
| 2011/0271681 | A1* | 11/2011 | Bagchi | F23R 3/286 60/737 |
| 2012/0047903 | A1* | 3/2012 | Williams | F02C 7/22 60/746 |

FOREIGN PATENT DOCUMENTS

| | | | |
|---|---|---|---|
| EP | 2743587 | A2 | 6/2014 |

OTHER PUBLICATIONS

Extended European Search Report dated Jan. 17, 2017 issued during the prosecution of corresponding European Patent Application No. 16187439.1 (7 pages).

* cited by examiner

*Primary Examiner* — Viet Le

(74) *Attorney, Agent, or Firm* — Locke Lord LLP; Scott D. Wofsy; Joshua L. Jones

(57) ABSTRACT

A nozzle includes a nozzle body defining longitudinal axis with a liquid circuit extending axially in a downstream direction from a liquid inlet to a spray orifice, and an air circuit, e.g. an inner air circuit, extending axially downstream from an upstream air inlet to an air outlet proximate the spray orifice. An air swirler, e.g., an inner air swirler is mounted in the air circuit, wherein at least a portion of the air swirler is flush with or protrudes axially upstream relative to the air inlet.

12 Claims, 3 Drawing Sheets

AIR ENTRANCE EFFECT

BACKGROUND OF THE INVENTION

1. Field of the Invention

The present disclosure relates to injectors and nozzles, and more particularly to nozzles and injectors such as used in fuel injection in gas turbine engines.

2. Description of Related Art

A variety of devices and methods are known in the art for injecting fuel into gas turbine engines. Of such devices, many are directed to injecting fuel into combustors of gas turbine engines. Typical nozzles for fuel injectors incorporate swirlers to induce atomization on liquid fuel issued from the nozzle, as well as effect dispersion of the atomized droplets for good fuel/air mixing. The action of imparting swirl to a flow naturally results in a pressure-loss of the fluid passing through the swirler. This pressure-loss is exacerbated by the presence of flow-separations near the leading-edge of the vane (or entrance to the vaned passage). The pressure-loss which occurs due to the leading-edge flow separations is considered a parasitic loss of energy that could otherwise be used for atomization. Such flow separations also reduce the amount of air which can pass through the swirler passage for a given (fixed) amount of available pressure (pressure-drop through the swirler passage). There is an ongoing desire to reduce the pressure-loss and increase the amount of air flow through fuel nozzles in gas turbine engines.

Such conventional methods and systems have generally been considered satisfactory for their intended purpose. However, there is an ongoing need for swirlers with ever lower pressure loss. The present disclosure provides a solution for this need.

SUMMARY OF THE INVENTION

A nozzle includes a nozzle body defining longitudinal axis with a liquid circuit extending axially in a downstream direction from a liquid inlet to a spray orifice, and an air circuit, e.g. an inner air circuit, extending axially downstream from an upstream air inlet to an air outlet proximate the spray orifice. An air swirler, e.g., an inner air swirler, is mounted in the air circuit, wherein at least a portion of the air swirler is flush with or protrudes axially upstream relative to the air inlet.

The air swirler can be an axial swirler with a center body having axial swirl vanes extending outward therefrom. The center body can protrude axially upstream relative to the air inlet, and the axial swirl vanes can each have a respective leading edge that is substantially flush with the air inlet. It is also contemplated that the center body can have an upstream end that is substantially flush with the air inlet. It is also contemplated that the center body can have an upstream end that is downstream of the air inlet.

The air circuit can include a converging section that converges from the air inlet down to a non-converging inlet section of the air circuit. The center body and swirl vanes can extend axially through the converging section.

In another aspect, the air swirler can be positioned within an inlet section of the air circuit and the air circuit can include an outlet section downstream of the inlet section, the outlet section having a smaller cross-sectional area than the inlet section. The air swirler can have a downstream end positioned within a tapered section of the air circuit that necks down in cross-sectional area from the main section to the outlet section. It is also contemplated that the air swirler can have a downstream end positioned upstream of the necking section.

Each of the swirl vanes can have a leading edge that is flat, can be a single lead helical vane, and can have a constant thickness. The swirl vanes can be a full coverage set of vanes.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
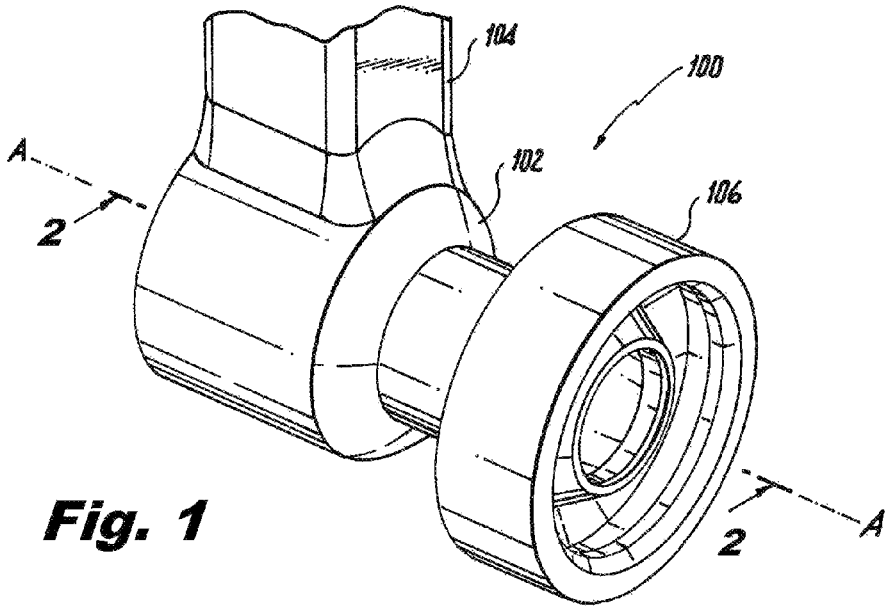
FIG. 1 is a perspective view of an exemplary embodiment of a nozzle constructed in accordance with the present disclosure, showing the nozzle as part of an injector.

Reference will now be made to the drawings wherein like reference numerals identify similar structural features or aspects of the subject disclosure. For purposes of explanation and illustration, and not limitation, a partial view of an exemplary embodiment of a nozzle in accordance with the disclosure is shown in FIG. 1 and is designated generally by reference character 100. Other embodiments of nozzles in accordance with the disclosure, or aspects thereof, are provided in FIGS. 2-5, as will be described. The systems and methods described herein can be used to improve performance of swirlers, for example for fuel injection in gas turbine engines.

Figure 2:
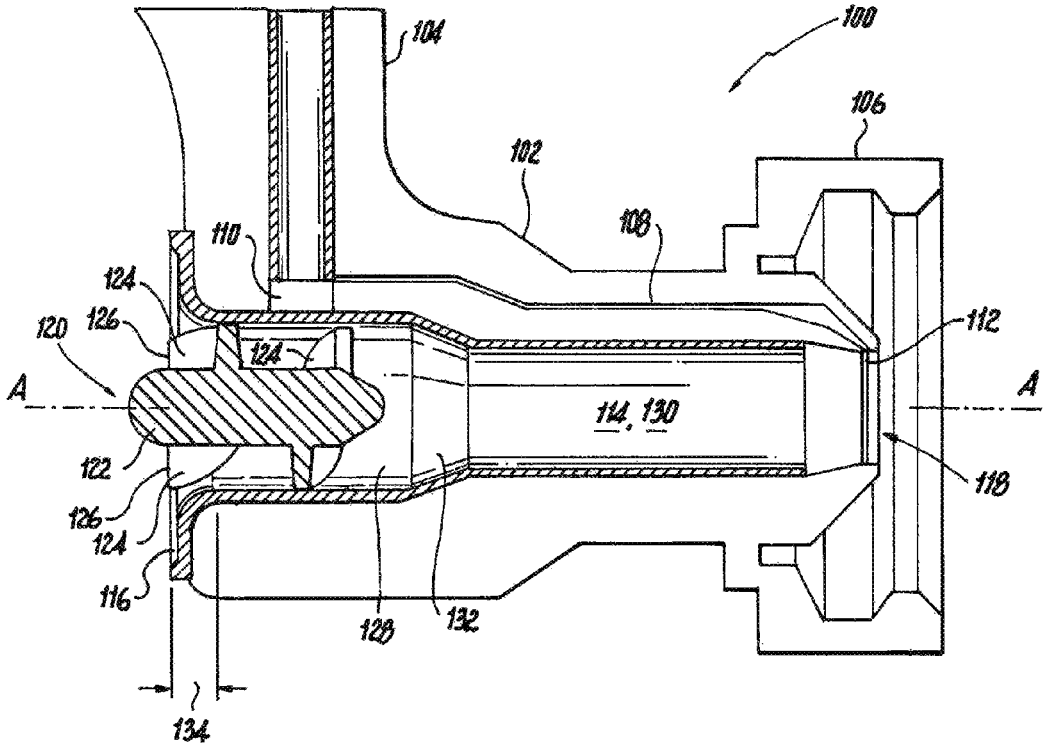
FIG. 2 is a cross-sectional side elevation view of the nozzle of FIG. 1, showing the inner air swirler and inner air circuit.

Nozzle 100 includes a nozzle body 102 that depends from an injector feed arm 104, and includes an outer air cap 106 for air blast atomization. As shown in FIG. 2, nozzle body 102 defines longitudinal axis A with a liquid circuit 108, e.g., for fuel to be injected, extending axially in a downstream direction from a liquid inlet 110 to a spray orifice 112. Nozzle body 102 also includes an inner air circuit 114 extending axially downstream from an upstream air inlet 116 to an air outlet 118 proximate spray orifice 112. An inner air swirler 120 is mounted in inner air circuit 114.

Inner air swirler 120 is an axial swirler with a center body 122 having axial swirl vanes 124 extending outward therefrom. At least a portion of inner air swirler 120 is flush with or protrudes axially upstream relative to air inlet 116. In the example shown in FIG. 2, center body 122 protrudes axially upstream relative to air inlet 113, and the axial swirl vanes 124 each have a respective leading edge 126 that is substantially flush with air inlet 116.

Figure 3:
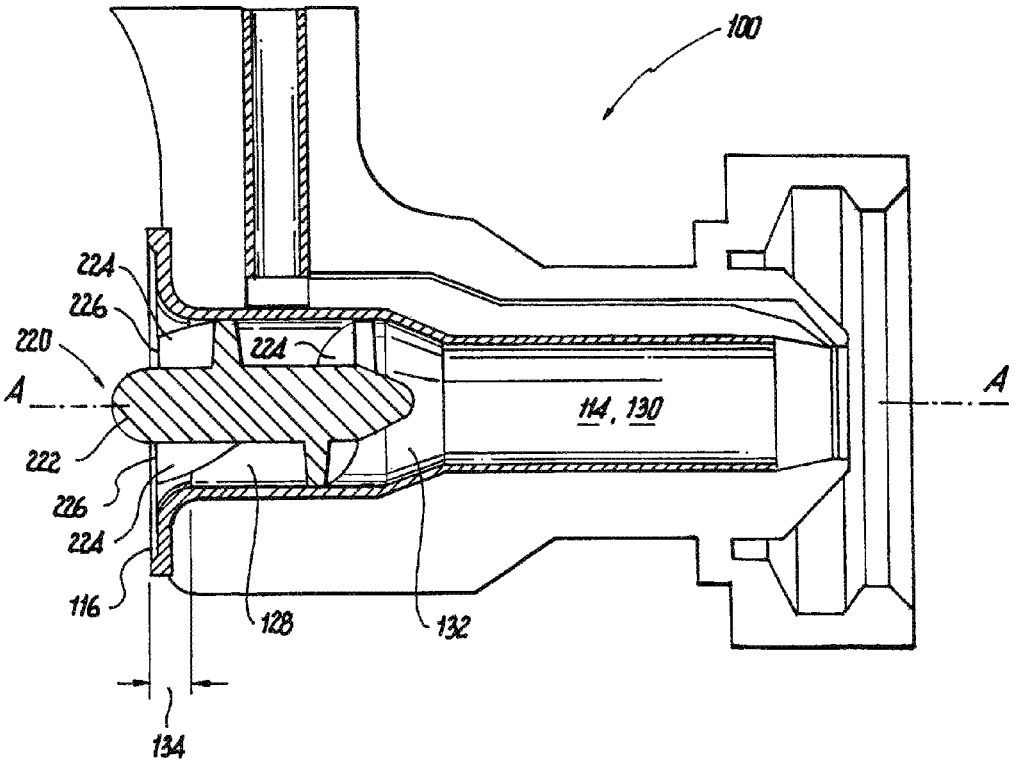
FIG. 3 is a cross-sectional side elevation view of the nozzle of FIG. 1, showing another exemplary embodiment of an inner air swirler in the inner air circuit.

Inner air circuit 114 includes an inlet section 128 extending from air inlet 116 toward an outlet section 130. Air circuit 114 also includes a tapered section 132 that necks down in area as it extends from inlet section 128 to outlet section 130. In the example shown in FIG. 2, center body 122 and vanes 124 do not extend downstream into tapered section 132 so the downstream ends of center body 122 and vanes 124 end upstream of tapered section 132. However, as shown in FIG. 3, it is also contemplated that a center body 222 and/or swirl vanes 224 of a swirler 220 can extend axially through the inlet section 128, and center body and/or vanes 224 can have downstream ends that are positioned within tapered section 132 or even further downstream. Swirler 220 is similarly situated at its upstream end to swirler 120 described above, and is essentially extended further axially in length towards the downstream end of inner air passage 114.

Each of the swirl vanes 124 and 224 has a leading edge 126/226 that is flat. Vanes 124 and 126 are single lead helical vanes (e.g., have a constant, helical pitch), and have a constant thickness. It is also contemplated that swirl vanes 124 and 224 can each form part of a full coverage set of vanes.

Figure 4:
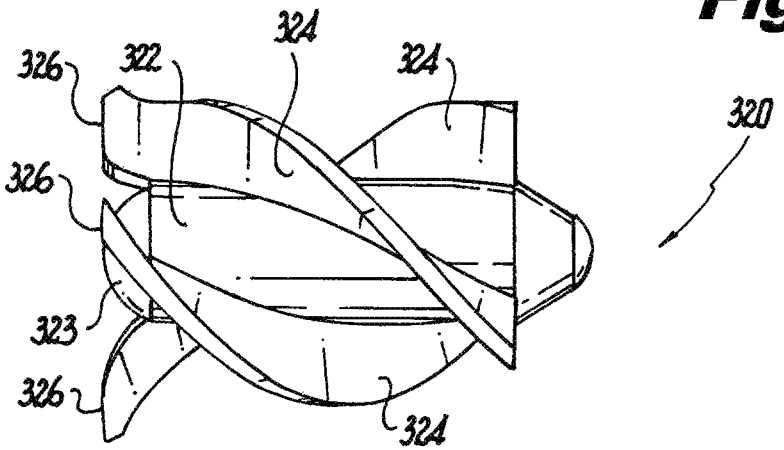
FIG. 4 is a side elevation view of another exemplary embodiment of an inner air swirler, showing the upstream end of the center body substantially flush with the leading edges of the vanes.
Figure 5:
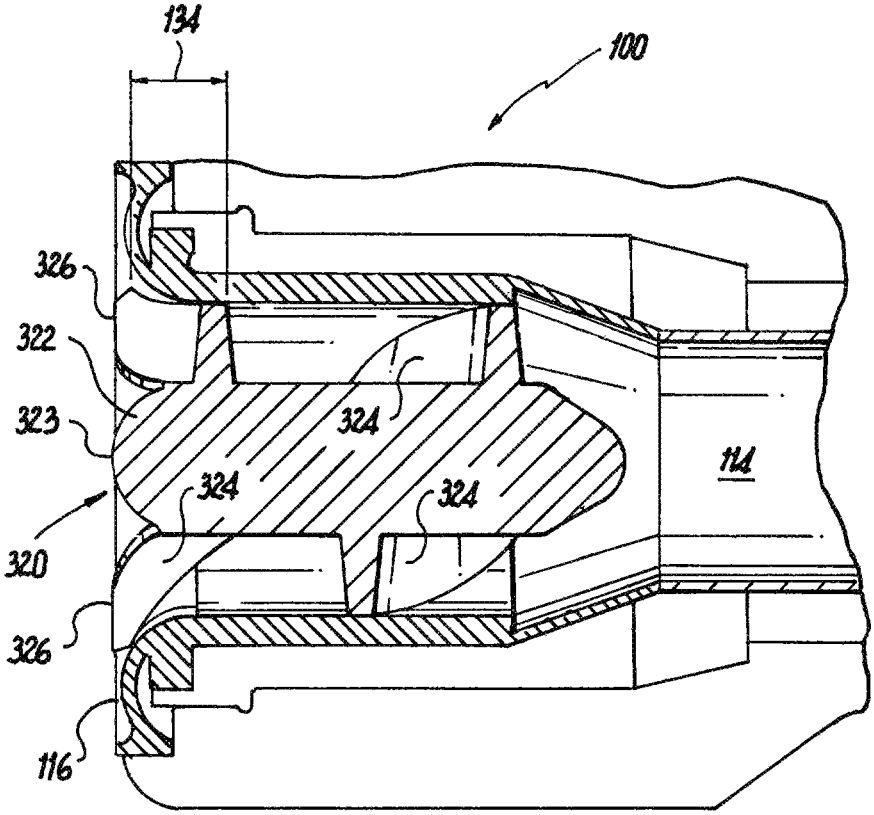
FIG. 5 is a cross-sectional side elevation view of a portion of the nozzle of FIG. 1, showing the inner air swirler of FIG. 4 within the inner air circuit.

With reference now to FIG. 4, another exemplary embodiment of a swirler 320 is shown, similar to swirlers 124 and 224 described above, however, in swirler 320, the center body 322 has an upstream end 323 that is substantially flush with the main portions of leading edges 326 of the helical vanes 324. The inner portions of leading edges 326 are swept to meet up with the constant diameter portion of center body 322. As shown in FIG. 5, leading edges 326 and upstream end 323 are substantially flush with air inlet 116. This provides benefits of flush/protruding inner air swirler portions while fitting into the form envelope of inner air circuit 114. Those skilled in the art will readily appreciate that the upstream end 323 could readily be modified to be downstream of air inlet 116.

Inner air circuit 114 includes a converging section 134 that converges down from air inlet 116 to non-converging inlet section 128 of inner air circuit 114. The center body 122, 222, and 322, and swirl vanes 124, 224, and 324 can extend axially through the converging section 134. This provides for any flow separations incident at leading portions of swirlers 120, 220, and 320 to be positioned upstream of the converging section. The converging flow through converging section 134 reduces these separations compared to traditional swirlers where the separations occur downstream of the converging flow. In this way, swirlers positioned in accordance with this disclosure substantially mitigate such separations and provide reduced flow-losses for a given pressure drop through inner air circuits compared to traditional swirler configurations. Swirler configurations as described herein provide for a larger effective area than traditional swirler configurations. In other words, for a given throat area, swirler configurations as described herein provide for greater flow therethrough than traditional swirler configurations with the same throat area. In embodiments described herein, swirlers extended through converging inlet portions, potentially eliminate the need for small diametral steps to bottom the swirlers for proper positioning when assembling, since the enlarged inlet does not allow the swirler to proceed downstream if it becomes dislodged, for example.

While shown an described in the exemplary contest of inner air circuits and inner air swirlers, those skilled in the art will readily appreciate that the systems and methods described herein can readily be applied to outer air circuits and outer air swirlers, intermediate air circuits and intermediate air swirlers, and/or any other suitable air circuits and air swirlers. For example, the leading edges of swirl vanes in outer air cap 106 can be positioned substantially flush with the inlet to outer air cap 106 to reduce pressure loss and/or increase effective area through outer air cap 106 relative to traditional configurations.

The methods and systems of the present disclosure, as described above and shown in the drawings, provide for swirlers with superior properties including reduced pressure loss and/or increased effective area relative to traditional configurations. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A nozzle comprising:

a nozzle body defining longitudinal axis with a liquid circuit extending axially in a downstream direction from a liquid inlet to a spray orifice, and an air circuit extending axially downstream from an upstream air inlet to an air outlet proximate the spray orifice; and an air swirler mounted in the air circuit, wherein at least a portion of the air swirler is flush with or protrudes axially upstream relative to the air inlet, wherein the air swirler is an axial swirler with a center body having axial swirl vanes extending outward therefrom, wherein the air circuit includes a converging section that converges down from the air inlet to a non-converging inlet section of air circuit, wherein the axial swirl vanes each have a respective leading edge that is upstream of the non-converging inlet section.

2. The nozzle as recited in claim 1, wherein the center body protrudes axially upstream relative to the air inlet.

3. the nozzle as recited in claim 1, wherein the axial swirl vanes each have a respective leading edge that is substantially flush with the air inlet.

4. The nozzle as recited in claim 1, wherein the center body has an upstream end that is flush with or downstream of the air inlet.

5. The nozzle as recited in claim 1, wherein the air swirler is an axial swirler with a center body having axial swirl vanes extending outward therefrom, wherein the center body and swirl vanes extend axially through the converging section.

6. The nozzle as recited in claim 1, wherein the air swirler is positioned within an inlet section of the air circuit and wherein the air circuit includes an outlet section downstream of the inlet section, the outlet section having a smaller cross-sectional area than the inlet section.

7. The nozzle as recited in claim 6, wherein the air swirler has a downstream end positioned within a tapered section of the air circuit that necks down in cross-sectional area from the inlet section to the outlet section.

8. The nozzle as recited in claim 6, wherein the air swirler has a downstream end positioned upstream of a necking section of the air circuit that necks down in cross-sectional area from the inlet section to the outlet section.

9. The nozzle as recited in claim 1, wherein each of the swirl vanes has a leading edge that is flat.

10. The nozzle as recited in claim 1, wherein each of the swirl vanes is a single lead helical vane.

11. The nozzle as recited in claim 1, wherein each of the swirl vanes has a constant thickness.

12. The nozzle as recited in claim 1, wherein the swirl vanes are a full coverage set of vanes.

* * * * *